US008462071B1

(12) United States Patent
Rudish et al.

(10) Patent No.: US 8,462,071 B1
(45) Date of Patent: Jun. 11, 2013

(54) IMPEDANCE MATCHING MECHANISM FOR PHASED ARRAY ANTENNAS

(75) Inventors: Ronald M. Rudish, Commack, NY (US); Brian M. Sullivan, Huntington, NY (US)

(73) Assignee: Exelis Inc., McLean, VA (US)

( * ) Notice: Subject to any disclaimer, the term of this patent is extended or adjusted under 35 U.S.C. 154(b) by 367 days.

(21) Appl. No.: 12/788,069

(22) Filed: May 26, 2010

(51) Int. Cl.
*H01Q 21/00* (2006.01)

(52) U.S. Cl.
USPC ..... 343/810; 343/797; 343/820

(58) Field of Classification Search
USPC ..... 343/797, 810, 816, 820–822
See application file for complete search history.

(56) References Cited

U.S. PATENT DOCUMENTS

| | | | | |
|---|---|---|---|---|
| 6,734,829 | B1 * | 5/2004 | Gottl | 343/815 |
| 2002/0158808 | A1 * | 10/2002 | Inoue | 343/795 |
| 2007/0146225 | A1 * | 6/2007 | Boss et al. | 343/797 |
| 2010/0007572 | A1 * | 1/2010 | Jones et al. | 343/798 |

OTHER PUBLICATIONS

J. J. Lee, "Effects of Metal Fences on the Scan Performance of an Infinite Dipole Array," IEEE Transactions on Antennas and Propagation, vol. 38, No. 5, May 1990.

S. Edelberg et al., "Mutual Coupling Effects in Large Antenna Arrays II: Compensation Effects," IRE Transactions on Antennas and Propagation, vol. Ap-8, Jul. 1960.

N. R. Brennecke et al., "Use of Fences to Optimize Operating Impedance of Phased Arrays, Using an Improved Measuring Technique," Antennas and Propagation Society International Symposium, Sep. 1964, pp. 134-142.

* cited by examiner

*Primary Examiner* — Anh Tran
(74) *Attorney, Agent, or Firm* — Edell, Shapiro & Finnan, LLC

(57) ABSTRACT

A technique for improving impedance matching in a phased array antenna involves placing a segmented fence around the antenna elements of the array. The antenna elements are arranged above a ground surface such as a ground plane. The segmented fence includes spaced-apart conductive projections electrically coupled to and extending from the ground surface, such that the segmented fence partially terminates electric fields traveling in directions parallel to the ground surface. The segmented fence lies in paths extending in at least two directions along the ground surface to define fence enclosures that surround individual antenna elements. With dual-polarization or multi-polarization dipole antenna elements, the fence enclosures partially terminate the electric field in each direction parallel to the ground surface to simplify impedance matching without unduly restricting the magnetic field.

25 Claims, 5 Drawing Sheets

IMPEDANCE MATCHING MECHANISM FOR PHASED ARRAY ANTENNAS

BACKGROUND

Electronically scanned antennas such as phased arrays are replacing older-technology, mechanically scanned antennas in contexts where the higher cost of electronically scanned antennas can be justified by their superior performance. Electronically scanned antennas are also the antenna type of choice in new systems that require agility or economy of swept volume. Such antennas can be used, for example, in electronic warfare (EW) systems to increase effective radiated power (ERP) over that available from a wide-beam-width, non-scan antenna providing the same angular coverage. System requirements may necessitate that these antennas operate over multi-octave frequency ranges and scan beams of any polarization from the broadside direction to at least 45° from broadside in any direction.

Typically, electromagnetic signals to be transmitted are supplied from the transmitter system to the antenna elements of the array via transmission lines. To maximize radiation of available power, the input impedance of the antenna elements must be matched to the impedance of the transmission lines supplying the transmission signals. For example, with dipole antenna elements, the input impedance of each dipole leg must be matched to that of its transmission line. With phased array antennas, a mutual coupling exists between elements of the array, with each element being impacted by the other elements in the array, particularly those in the immediate vicinity. The effective impedance of each element is the sum of its own impedance and the mutual impedances resulting from the surrounding elements. The antenna beam pattern of a phased array can be electronically scanned over a range of pointing angles by changing the relative phases of the signals exciting the elements in the array. However, changing the relative phases of the antenna elements alters the mutual impedance coupling among the elements; hence, the terminal impedance experienced by each element varies over a range of scan angles.

Impedance matching can be further complicated by the fact that the impedance may vary differently for different scan directions. In particular, the impedance variation from beam scanning in the plane containing the electric field vector (E-plane) of a dipole antenna element may be very different from the impedance variation from beam scanning in the plane containing the magnetic field vector (H-plane). If the impedance mismatch between the transmission line and the antenna element produces a Standing Wave Ratio (VSWR) greater than 3:1, protection circuits within each transmitter amplifier might shut down the amplifier to prevent blowout. Achieving impedance matching within this tolerance over the required broad bandwidth, polarization agility, and scan ranges can be very challenging.

Techniques have been proposed to improve impedance matching in certain types of phased array antennas. These techniques cause the impedance variation from beam scanning in the plane containing the electric field vector (E-plane) to be much more like the impedance variation from beam scanning in the plane containing the magnetic field vector (H-plane). This reduces the range of impedances that has to be matched.

More specifically, it has been shown that, with single-polarization dipole arrays, grounded metal fences that separate dipoles in their E-plane, as shown in FIG. 1, modify E-plane performance while leaving H-plane performance virtually unchanged. As shown in FIG. 1, each column of single-polarization dipole antenna elements 10 is separated from adjacent columns of antenna elements by continuous, linear metal fences 12. This phenomenon can be used to render the two scan impedances (E-plane and H-plane) close to each other, thus allowing the same matching scheme to be used for both scan directions. The mechanism at work here is that the fences provide an alternative termination for some of the dipoles' electric field that would otherwise terminate at the neighboring dipoles in the E-plane direction.

This technique, while quite effective, applies only to single-polarization dipole arrays. In dual or multi-polarized dipole arrays, the fences that separate one set of dipoles in their E-plane will separate the orthogonal set of dipoles in their H-plane, causing the magnetic field of these dipoles to be restricted. By restricting the magnetic field, these "H-plane fences" would cause more energy storage, which would reduce the bandwidth over which the array can be impedance matched. Consequently, the grounded fence scheme for improving impedance matching is not readily extendable to dual or multi-polarized antenna arrays.

SUMMARY

A technique for improving impedance matching in a dual-polarized or multi-polarized dipole phased array antenna involves placing a discontinuous, segmented fence around the antenna elements of the array. The antenna elements are arranged above a ground surface such as a ground plane. The segmented fence includes spaced-apart conductive projections electrically coupled to and extending from the ground surface, such that the segmented fence partially terminates electric fields traveling in directions parallel to the ground surface. The segmented fence lies in paths extending in at least two directions along the ground surface to define fence enclosures that surround individual antenna elements. With dual-polarized or multi-polarized dipole antenna elements, the fence enclosures partially terminate the electric field in each direction parallel to the ground surface to improve impedance matching without unduly restricting the magnetic field.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DETAILED DESCRIPTION

Figure 1:
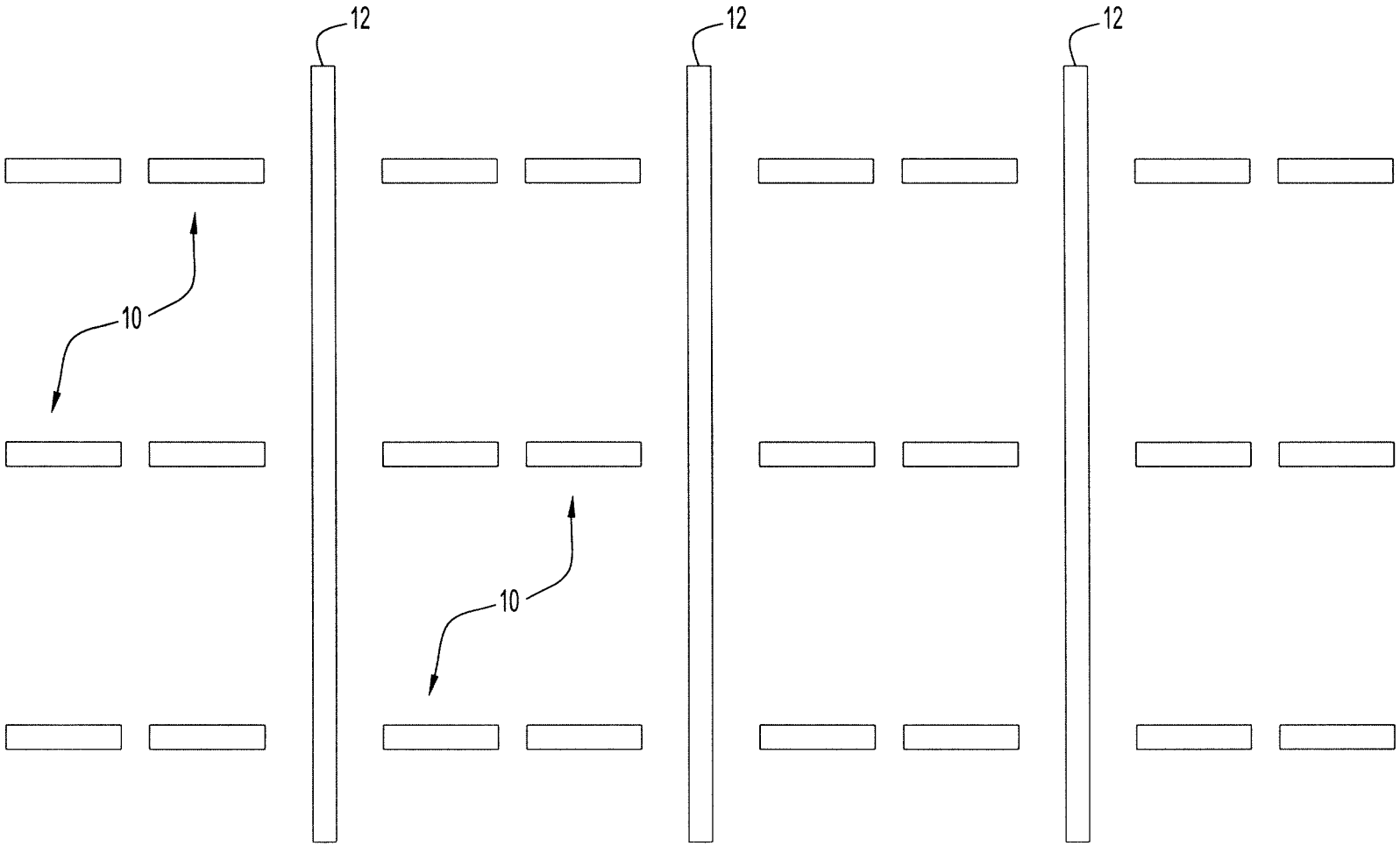
FIG.1 PRIOR ART
FIG. 1 is a plan view of a conventional, single-polarization dipole phased array antenna with grounded, solid metal fences separating the dipole elements in their E-plane.

The system described herein extends techniques for simplifying impedance matching in phased array antennas to dual-polarized and multi-polarized dipole arrays, while avoiding the problem of unduly restricting the magnetic field of the antenna elements. The technique is illustrated conceptually in the plan view of a dual-polarized dipole phased array antenna 20 shown in FIG. 2. In this example, each radiator element 22 of the array 20 comprises a pair of orthogonally-oriented dipoles 22*a*, 22*b* that are backed by a common ground-plane reflector 24 comprising an electrically conductive material such as aluminum. Each dipole element 22*a*, 22*b* has two co-linear legs that extend in opposite directions from the element center. Thus, the dipole pair has four legs that extend outward like the four cardinal points of a compass (i.e., in a cross-shaped pattern). The antenna elements 22 are arranged in a rectangular array, in this example, comprising four rows and four columns. It will be appreciated that this example is shown for convenience, and the invention is not limited to any particular number or arrangement of antenna elements.

Figure 2:
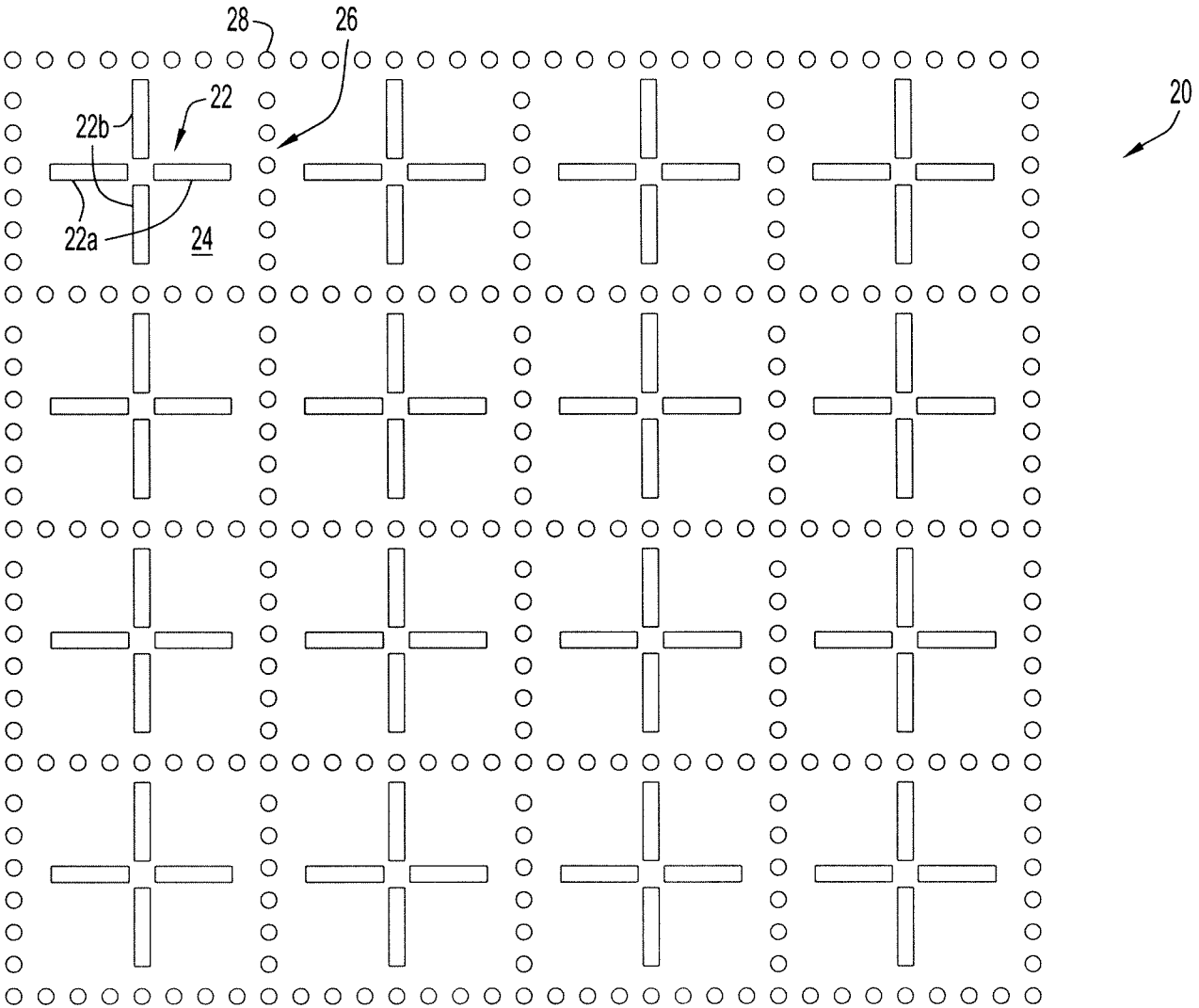
FIG. 2 is a plan view of a phased array antenna with dual-polarization dipole elements separated by a segmented fence in accordance with an embodiment of the invention.

A segmented fence 26 extends along a plurality of paths in at least two directions among the antenna elements. In this example, segmented fence 26 comprises a grid of intersecting rows and columns to form an array of rectangular (e.g., square) fence enclosures that respectively surround individual antenna elements 22, with each antenna element comprising an orthogonal pair of dipoles. While the rectangular fence enclosures shown in FIG. 2 are particularly well suited for antenna elements arranged in a rectangular array, the invention is not limited to this particular fence configuration, and other segmented fence configurations may be suitable depending on the design of the antenna elements and the arrangement of the antenna elements. For example, hexagonal fence enclosures or round fence enclosures may be employed.

Segmented fence 26 comprises a plurality of spaced-apart conductive projections 28 electrically coupled to and extending substantially perpendicularly from the ground plane along the path of segmented fence 26, resulting in a discontinuous or intermittent barrier with alternating conductive projections and openings. The openings between projections 28 are essentially free of conductive material to permit passage of at least some of the magnetic field through segmented fence 26. Thus, as used herein the term "segmented" refers to a fence that is discontinuous, slotted, broken, or intermittent, comprising a series of projections (e.g., posts, prongs, etc.) arranged along lines or paths with openings or spacings between the projections.

Unlike single-polarization dipole elements, the dual-polarization, cross-dipole elements result in magnetic field vectors in two orthogonal directions (e.g., both left-right and up-down in FIG. 2), so that a continuous fence in either direction is problematic, since the magnetic field of at least one of the dipoles will be blocked. Using a grid of continuous fences in two directions to control the E-Plane impedances of both dipoles would also impact the H-Plane magnetic fields of both of the cross-dipole elements. Specifically, if a continuous fence is extended around all four sides of the antenna element, the fence behaves like a full waveguide and, in the H-Plane, the magnetic field is restricted by the fence, which introduces a cut-off frequency and increased energy storage. If one thinks of this arrangement as a resonant circuit, a continuous fence raises the Q value, making the circuit more narrowband.

By slotting fence 26 or by making fence 26 as lines of individual conductive posts rather than a continuous conductive surface, the dipoles' magnetic field is permitted to expand largely unimpeded while still providing for some of the dipoles' electric field to terminate at fence 26. Thus, segmented fence 26 avoids the excessive energy storage and the consequent reduction of bandwidth that would result from complete blockage of the H-Plane, while still providing the benefit of reducing the range of impedances to be matched. The segmented fence approach provides a beneficial tradeoff between the advantages of using a fence-like mechanism for impedance matching between the H-Plane and E-Plane with only a small disturbance to the magnetic field. In particular, the impedance matching benefit of the segmented fence is still quite substantial, albeit somewhat less than that of a continuous fence. However, the segmented fence greatly reduces the negative impact on the magnetic field that would be caused by a continuous fence.

Figure 3:
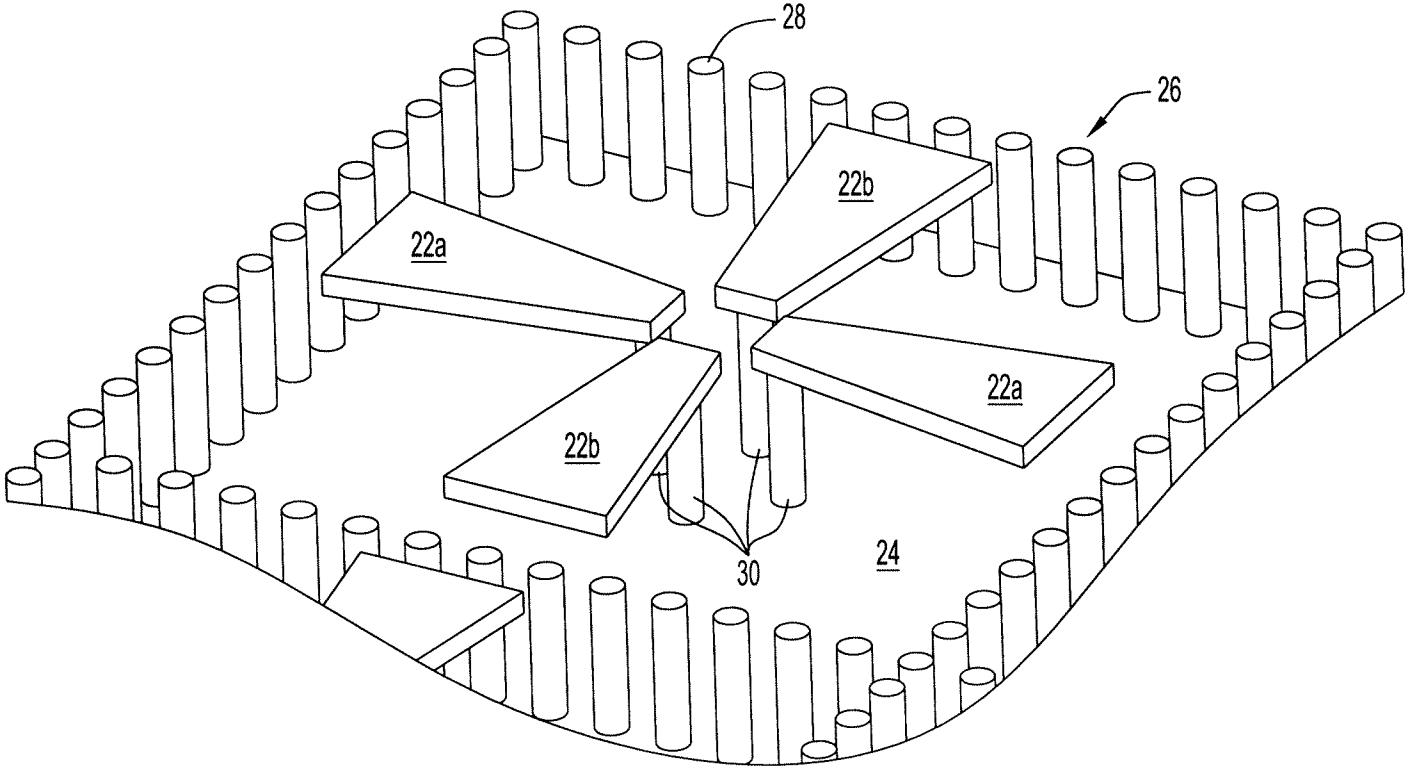
FIG. 3 is a perspective view of a dual-polarization dipole antenna element with bowtie shaped dipoles positioned above the ground plane, with each half-dipole being fed by a separate transmission line, wherein the antenna element is surrounded by a segmented fence.

FIG. 3 shows one implementation of a dual-polarized dipole antenna element 22 in which the four legs (dipole halves 22*a*, 22*b*) are in a plane that is parallel to the ground plane 24 and located less than a half-wavelength, at the highest operating frequency, in front of (above) ground plane 24. Each leg is attached to a feed post 30 that is perpendicular to the dipole half and extends toward the ground plane. In a plane parallel to ground plane 24, each of the four half-dipole legs 22*a*, 22*b* extends outward in a radial direction from an inner end near the center of antenna element 22 to an outer end (the end closer to fence 26). The four posts 30 are clustered near the center of antenna element 22, with each post extending from ground plane 24 to the inner end of one of the half-dipole legs 22*a*, 22*b*. The four posts 30 are electrically insulated from ground plane 24 and are connected, respectively, to four coaxial transmission lines (e.g., 50Ω lines) that extend toward four solid-state power amplifiers (not shown) on the other side of ground plane 24. These lines have the same characteristic impedance as the nominal output impedance of the power amplifiers.

Thus, the arrangement shown in FIG. 3 is a balanced line approach involving four wire transmission lines, in which each dipole half within the dual-polarized dipole antenna element has its own transmission line. According to another implementation, an unbalanced, two-wire transmission line arrangement can be used in which both halves of each dipole are fed by a single transmission line. For example, two coaxial transmission lines (one for each dipole) can be used along with a pair of baluns. In this approach, the outer conductor of the coaxial feed line is grounded where it enters through the ground plane, with the dielectric of the coaxial transmission line insulating the center conductor. With the balun, the coaxial transmission line goes through the ground plane as an unbalanced coaxial line and transforms from a coaxial line to a balanced two-wire line on the radiating side of the ground plane.

In the four transmission line scheme shown in FIG. 3, feed posts 30 are insulated from ground plane 24 and, therefore, do not electrically connect to ground plane 24 (no baluns are required). This arrangement provides are least two important advantages over a coaxial/balun approach. First, unlike the coaxial/balun approach, in which one amplifier feeds both halves of the dipole, the four transmission line scheme allows two separate amplifiers to feed one dipole (one amplifier feeding each half). Thus, in a dual-polarized dipole antenna element, four amplifiers can feed the antenna element, thereby supplying twice as much power to the antenna element relative to a balun approach involving only two amplifiers.

A second advantage results from the fact that the four feed posts are not grounded. The grounded posts of a coaxial/balun arrangement can potentially act as surface wave structures in some circumstances. For example, if the antenna array is scanned far enough in the direction of the E-Plane of one of the dipoles, a surface wave can be excited by the grounded coaxial feed lines and propagated along the array. In contrast, ungrounded posts contribute less to surface waves under such circumstances.

In the example shown in FIG. 3, each dipole pair 22*a*, 22*b* has a bowtie shape, wherein, in the plane of the dipole elements, each of the dipole halves has a cross-sectional dimension, in a direction perpendicular to the radial direction, that increases with increasing radial distance from the center of antenna element 22, such that each half dipole is wider at its outer end than at its inner end. The dipoles can be formed as essentially planar structures on a printed circuit, for example. According to another implementation, the dipoles can be shaped like a cylindrical rod or wire. It will be appreciated that these are examples only, and the invention is not limited to any particular dipole arrangement or structure.

Figure 4:
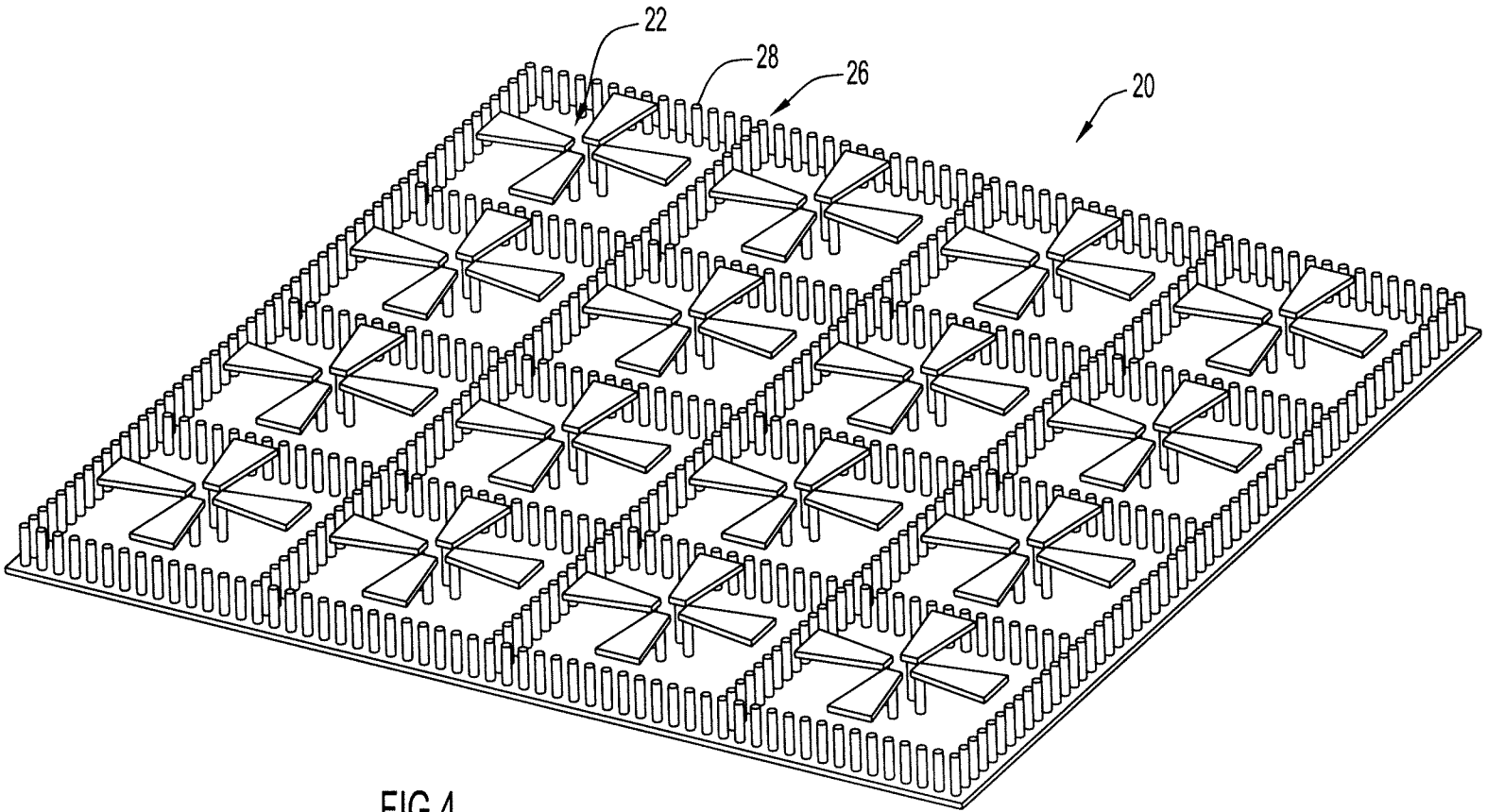
FIG. 4 is a perspective view of a 4-by-4 element phased array antenna with bowtie shaped dual-polarization dipole elements and a segmented fence comprising post-like conductive projections.
Figure 5:
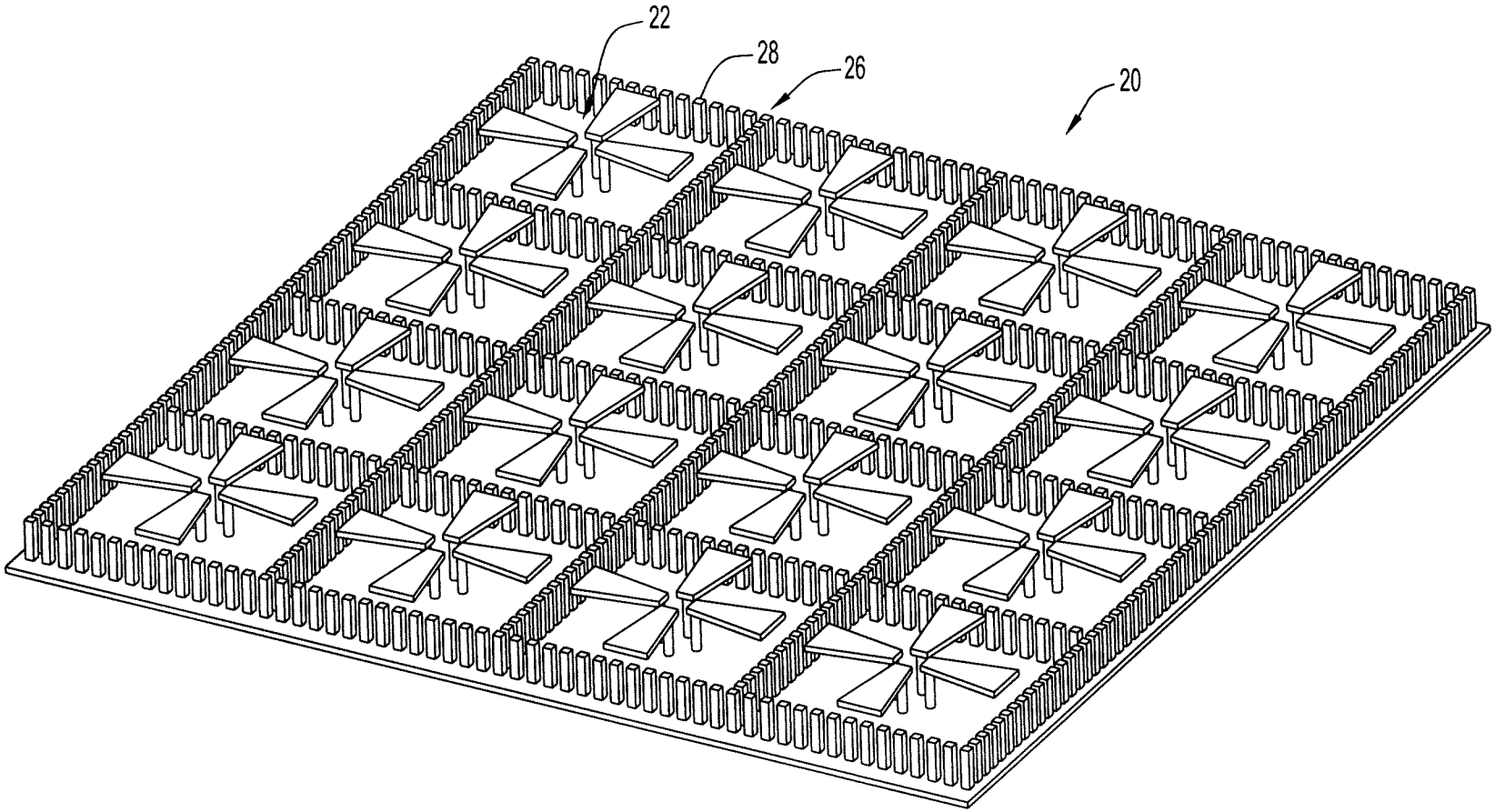
FIG. 5 is a perspective view of a 4-by-4 element phased array antenna with bowtie shaped dual-polarization dipole elements and a segmented fence comprising comb-like conductive projections.

The conductive projections that constitute the segmented fence can be made of any suitable electrically-conductive material and can be configured in a number of ways. For example, as shown in the four-by-four rectangular array shown in FIG. 4, each conductive projection 28 can comprise a cylinder-like post with a substantially round cross-section in a plane parallel to ground plane 24 (the cylinder-like post configuration is also shown in FIG. 3). In the four-by-four rectangular array shown in FIG. 5, conductive projections 28 have a more rectangular cross section and resemble prongs or teeth of a comb-like structure. Any of a variety of other cross-sectional shapes can be used for projections 28, and a suitable cross-sectional shape may be determined at least in part based on considerations such as ease of manufacture. For example, one option is to form at least portions of fence 26 from a sheet or plate of metal that extends through ground plane 24 and that is slotted above ground plane 24 to form the individual projections 28 (e.g., the projections could remain coupled to each other behind the ground plane). In this case, projections 28 would have a thickness equal to the thickness of the metal sheet and a width determined by the size and spacing of the slots. As previously noted, projections 28 are electrically coupled to ground plane 24; consequently, the grounded end of segmented fence 26 is maintained at ground potential.

It will be appreciated that the projections shown in the drawings are not necessarily to scale. Regardless of the cross-sectional shape of the individual projections of the segmented fence, it is preferable, within mechanical constraints and practical manufacturing limits, to minimize the thickness of the fence such that linear portions of the fence resemble thin, planar, slotted walls extending perpendicularly from the ground plane. In other words, in a direction perpendicular to a path along which a portion of the segmented fence extends, the cross-sectional dimension of the projections is made as small as possible. For example, the post-like projections shown in FIGS. 3 and 4 can be relatively thin wires with small radii. Such wires can be embedded in a dielectric or other non-metal support to provide sufficient mechanical rigidity.

The alternating projections and openings result in a segmented fence that is partially open and partially closed. The open/closed ratio of the segmented fence is determined by the width of the projections in the direction along which the segmented fence extends and the width of the openings between adjacent projections. This ratio plays a role in the tradeoff between improvement in matching the impedance variations of the E-Plane and H-Plane as a function of scan angle and avoiding blockage of the magnetic field vector (H-Plane). The benefit obtained by modifying the E-plane scan impedance improves as the "closed" percentage of the fence is increased; however, blockage of the magnetic field is also increased, resulting in greater energy storage and signal bandwidth reduction. Conversely, increasing the percentage of the segmented fence that is "open" avoids blockage of the magnetic field and bandwidth reduction but also reduces the effectiveness of the fence in modifying the E-Plane scan-angle impedance variation to resemble the H-Plane scan-angle impedance variation, making impedance matching more challenging. The optimal open/closed ratio (or, equivalently, "opened" or "closed" percentage) of the segmented fence depends at least in part on the particular design and operating requirements of the phased array antenna. For example, in phased array antennas that have been experimentally tested with a segmented fence, an open/closed ratio of about unity (i.e., a closed percentage of about 50%) provided a beneficial tradeoff. In many applications and systems, a closed percentage between 40% and 60% provides a beneficial tradeoff. In narrow band applications, where a greater restriction on bandwidth may be more acceptable than in wideband applications, a greater closed percentage may be acceptable compared to wideband systems.

In addition to the open/closed ratio of the segmented fence, another consideration is the width of the projections and openings, which dictates whether the segmented fence has fine or coarse projections and openings. Smaller widths result in a segmented fence with many closely-spaced, narrow projections over a given span of the fence, whereas larger widths produce fewer, wider-spaced, broader projections over a similar span of the fence. From an electrical standpoint, finer projections and openings generally perform better than coarser projections and openings. However, there is a tradeoff between electrical performance and mechanical requirements, and mechanical constraints and manufacturing considerations limit how small the width of the projections and openings can be made in practice. In general, the spacing between adjacent antenna elements is less than a half wavelength at the operating frequency of the antenna array; consequently, the width of individual projections and the width of the openings between adjacent projections is a small fraction of a half wavelength. Typically, the width of the projections and the width of the openings between adjacent projections is at least an order of magnitude less than the wavelength of the signals transmitted and/or received by the antenna array. Thus, for example, in a rectangular enclosure surrounding an antenna element, each side of the enclosure can include at least ten spaced-apart projections, and may include tens or even hundreds of projections.

The height of the conductive projections of the segmented fence (i.e., how far the projections extend from the ground plane) can be selected based on factors such as the height of the dipoles above the ground plane and the width of the dipoles in the vicinity of the fence. For example, the projections may extend to a height greater than the height of the dipoles in some antenna designs, while the projection may extend to a height less than the height of the dipoles in other systems.

While described in the context of dual-polarized and multi-polarized dipole phased array antennas, the invention is not limited to dipole arrays, and the segmented fence arrangement of the present invention can be used with virtually any type of antenna elements and any type of polarization, particularly those that present challenges in impedance matching or in suppression of surface waves. Likewise, the segmented fence arrangement has been described in the context of a phased array antenna in which the antenna elements are arranged in a rectangular grid. However, the segmented fence concept can also be employed in other types of antenna arrangements such as phase array antennas in which the antenna elements are arranged in a triangular grid (e.g., where each interior antenna element has six neighboring elements arranged in a hexagon around the antenna element). Further, the segmented fence has been described in the context of a planar array in which the array is disposed along a ground plane. More generally, the segmented fence concept can be used in phased array antennas of any shape including non-planar arrays in which the ground surface is not strictly planar.

Having described preferred embodiments of a new and improved impedance matching mechanism for phased array antennas, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A phased array antenna, comprising:

a ground surface;

a plurality of antenna elements arranged in an array along the ground surface; and a segmented fence comprising a plurality of spaced-apart conductive projections electrically coupled to and extending from the ground surface, wherein the segmented fence lies in a plurality of paths extending in at least two directions along the ground surface to define fence enclosures that surround individual ones of the antenna elements such that the individual ones of the antenna elements are disposed completely within respective fence enclosures.

2. The phased array antenna of claim 1, wherein:

the antenna elements are arranged in a rectangular array; and the segmented fence comprises a grid of intersecting rows and columns such that the fence enclosures comprise an array of rectangular fence enclosures, wherein individual rectangular fence enclosures respectively surround the individual ones of the antenna elements.

3. The phased array antenna of claim 1, wherein the ground surface is a ground plane.

4. The phased array antenna of claim 1, wherein the antenna elements comprise dual-polarization or multi-polarization dipole elements disposed above the ground surface.

5. The phased array antenna of claim 4, wherein the antenna elements comprise bowtie-shaped dual-polarization dipole elements.

6. The phased array antenna of claim 4, further comprising a plurality of feed lines for each of the antenna elements, wherein each of the feed lines is coupled to one-half of a dipole element within an antenna element such that each half dipole has its own separate feed line.

7. The phased array antenna of claim 6, wherein the antenna elements comprise four half-dipole legs, and four separate feed lines respectively supply the four half-dipole legs.

8. The phased array antenna of claim 6, wherein the plurality of feed lines is free of baluns.

9. The phased array antenna of claim 1, wherein the antenna elements include radiators comprising printed circuits.

10. The phased array antenna of claim 1, wherein the conductive projections comprise post-like projections.

11. The phased array antenna of claim 1, wherein the conductive projections are spaced apart in a comb-like structure.

12. The phased array antenna of claim 1, wherein the conductive projections are embedded in a dielectric material.

13. A method of manufacturing a phased array antenna, comprising:

providing a ground surface;

arranging a plurality of antenna elements in an array along the ground surface; and forming a segmented fence comprising a plurality of spaced-apart conductive projections electrically coupled to and extending from the ground surface, wherein the segmented fence lies in a plurality of paths extending in at least two directions along the ground surface to define fence enclosures that surround individual ones of the antenna elements such that the individual ones of the antenna elements are disposed completely within respective fence enclosures.

14. The method of claim 13, wherein:

the antenna elements are arranged in a rectangular array and individual antenna elements comprise an orthogonal pair of elements; and the segmented fence is formed as a grid of intersecting rows and columns such that the fence enclosures comprise an array of rectangular fence enclosures, wherein individual rectangular fence enclosures respectively surround the individual ones of the antenna elements.

15. The method of claim 13, further comprising forming the antenna elements as dual-polarization or multi-polarization dipole elements disposed above the ground surface.

16. The method of claim 15, further comprising coupling each half dipole of an antenna element to its own separate feed line.

17. A method of operating a phased array antenna, comprising:

transmitting or receiving signals from a plurality of antenna elements in an array disposed above a ground surface;

partially limiting the electric field and the magnetic field of the signals with a segmented fence comprising a plurality of spaced-apart conductive projections electrically coupled to and extending from the ground surface, the segmented fence lying in a plurality of paths extending in at least two directions along the ground surface to define fence enclosures that surround individual ones of the antenna elements such that the individual ones of the antenna elements are disposed completely within respective fence enclosures.

18. The method of claim 17, wherein:

the signals are transmitted or received from the antenna elements arranged in a rectangular array; and the electric field and magnetic field are partially limited by the segmented fence arranged as a grid of intersecting rows and columns such that the fence enclosures comprise an array of rectangular fence enclosures, wherein individual rectangular fence enclosures respectively surround the individual ones of the antenna elements.

19. The method of claim 17, wherein the signals are transmitted via dual-polarization or multi-polarization dipole antenna elements.

20. The phased array antenna of claim 1, wherein a closed percentage of segmented fence is between 40% and 60%.

21. The phased array antenna of claim 1, wherein a width of the conductive projections and a width of openings between adjacent conductive projections are at least an order of magnitude less than an operating wavelength of the antenna elements.

22. The method of claim 13, wherein the segmented fence is formed with a closed percentage between 40% and 60%.

23. The method of claim 13, wherein a width of the conductive projections and a width of openings between adjacent conductive projections are at least an order of magnitude less than an operating wavelength of the antenna elements.

24. The method of claim 17, wherein partially limiting the electric field and the magnetic field is performed with segmented fence having a closed percentage between 40% and 60%.

25. The method of claim 17, wherein partially limiting the electric field and the magnetic field is performed with a segmented fence having a width of the conductive projections and a width of openings between adjacent conductive projections that are at least an order of magnitude less than an operating wavelength of the antenna elements.

* * * * *